US008915414B2

(12) United States Patent
Popovich et al.

(10) Patent No.: US 8,915,414 B2
(45) Date of Patent: Dec. 23, 2014

(54) COMBUSTION FASTENER TOOL WITH LOCKOUT MECHANISM

(75) Inventors: Michael S. Popovich, Bartlett, IL (US); Tomasz Sikora, River Grove, IL (US); David Jablonski, Wheaton, IL (US)

(73) Assignee: Illinois Tool Works Inc., Glenview, IL (US)

( * ) Notice: Subject to any disclaimer, the term of this patent is extended or adjusted under 35 U.S.C. 154(b) by 457 days.

(21) Appl. No.: 13/370,557

(22) Filed: Feb. 10, 2012

(65) Prior Publication Data

US 2013/0206809 A1 Aug. 15, 2013

(51) Int. Cl.
*B25C 1/08* (2006.01)
*B25C 1/14* (2006.01)

(52) U.S. Cl.
CPC .. *B25C 1/08* (2013.01); *B25C 1/143* (2013.01)
USPC ..... 227/8; 227/9; 227/10; 227/156

(58) Field of Classification Search
CPC ..... B25C 1/143; B25C 1/008; B25C 1/08
USPC ..... 227/8–10, 156
See application file for complete search history.

(56) References Cited

U.S. PATENT DOCUMENTS

| | | | |
|---|---|---|---|
| 3,643,850 | A | 2/1972 | Endo et al. |
| 3,797,721 | A | 3/1974 | Clumb |
| 4,153,193 | A | 5/1979 | Urbanowicz |
| 4,479,599 | A | 10/1984 | Conrad |
| 5,016,802 | A | 5/1991 | Haytayan |
| 5,135,150 | A | 8/1992 | Chun |
| 5,429,291 | A | 7/1995 | Thompson |
| 5,465,893 | A | 11/1995 | Thompson |
| 5,518,161 | A | 5/1996 | Thompson |
| 5,897,045 | A | 4/1999 | Olvera |

(Continued)

FOREIGN PATENT DOCUMENTS

| | | |
|---|---|---|
| EP | 1 484 139 A1 | 12/2004 |
| EP | 1498225 | 1/2005 |
| EP | 1 997 589 A1 | 12/2008 |

OTHER PUBLICATIONS

International Searching Authority, ISA/EP, International Search Report and Written Opinion mailed Jul. 21, 2010 for PCT International Application PCT/US2010/028836, International Filing Date Mar. 26, 2010; 13 pages.

(Continued)

*Primary Examiner* — Michelle Lopez
(74) *Attorney, Agent, or Firm* — Maurice E. Finnegan, III; Beem Patent Law Firm

(57) ABSTRACT

A fastener actuation system for driving fasteners into a work surface separated a significant distance from a user, the system comprising a fastener actuation tool coupled to a pole assembly, the assembly including a lockout mechanism disposed within the tool. The tool may have a firing pin assembly configured such that depression of the barrel assembly against the work surface loads a firing pin into a ready-to-fire position. In addition, the tool may have a trigger sleeve slidable within the tool housing and having a ramp surface such that forward motion of the trigger sleeve may cause a trigger sear to move along the ramp surface until a point where the sear disengages and the firing pin fires. The lockout mechanism may include a ball and a receptacle, where the receptacle receives the ball if the tool is in an acceptable orientation and does not receive the ball otherwise.

19 Claims, 3 Drawing Sheets

(56) References Cited

U.S. PATENT DOCUMENTS

| | | | |
|---|---|---|---|
| 6,364,190 | B1 | 4/2002 | Tor |
| 6,547,120 | B1 | 4/2003 | Popovich et al. |
| 7,014,085 | B2 | 3/2006 | McCullough |
| 7,097,085 | B2 | 8/2006 | Arnold et al. |
| 7,121,598 | B2 | 10/2006 | Pourtier et al. |
| 7,228,917 | B2 | 6/2007 | Davis et al. |
| 7,258,261 | B1 | 8/2007 | Reyes |
| 7,584,879 | B2 | 9/2009 | Blessing et al. |
| 7,597,227 | B2 | 10/2009 | Blessing et al. |
| 7,896,210 | B2 | 3/2011 | Popovich et al. |
| 2008/0029567 | A1 | 2/2008 | Blessing et al. |
| 2008/0099524 | A1 | 5/2008 | Blessing et al. |
| 2008/0106019 | A1 | 5/2008 | Blessing et al. |
| 2008/0296338 | A1 | 12/2008 | Blessing et al. |
| 2008/0302849 | A1 | 12/2008 | Blessing et al. |
| 2010/0270352 | A1 | 10/2010 | Popovich et al. |

OTHER PUBLICATIONS

International Searching Authority, ISA/EP, International Search Report and Written Opinion mailed Sep. 26, 2013 for PCT International Application PCT/US2013-025136, International Filing Date Feb. 7, 2013; 12 pages.

COMBUSTION FASTENER TOOL WITH LOCKOUT MECHANISM

BACKGROUND OF THE INVENTION

1. Field of the Invention

The present invention is directed to a lockout mechanism for a fastener driving tool used to install fasteners in a substrate, for example in an overhead application.

2. Description of the Related Art

A variety of different fastening driving tools exist for driving fasteners into numerous substrates, including tools used to install fasteners in situations where a significant separation between the user and the muzzle of the tool exists such as when a user wants to drive a fastener into a ceiling substrate. In these situations, fasteners may be loaded individually into the muzzle end of the tool while charges to drive the fasteners may be fed into the tool at a position behind a piston. Combustion of a charge causes the piston to be driven forward, thereby driving the fastener forward and into the substrate.

Due to the separation that may exist between the user and the muzzle of the tool, several tools employ an apparatus for extending the user's reach and for firing the tool. Oftentimes, tools with these extensions are fired by compressing the tool against the substrate or work surface and then providing a secondary compressive force to the entire apparatus to cause the tool to fire.

One drawback of tools operating in this fashion is the possibility of inadvertent actuation or misfiring. Applying too much pressure initially may cause the tool to actuate prematurely, which may cause the fastener to be driven in an undesired location or orientation. Alternatively, this pressure may cause the firing sequence to occur out of order, for example, causing the firing pin to release without sufficient force to combust a cartridge, resulting in a misfire of the tool.

One solution to this problem is described in U.S. Pat. No. 7,896,210, titled "Fastener Actuation System," and which was invented by two of the inventors named here. The '210 patent describes a system including a tool and a pole assembly couplable to the tool. The pole assembly includes a lockout mechanism that prevents the tool from firing when the tool is oriented generally below a horizontal level. While this lockout mechanism is successful at preventing unintended firing of the tool, it adds additional weight to the pole assembly. In addition, the tool still may be subject to misfiring if the pole assembly is not attached.

What is needed is a fastener actuation system that overcomes the drawbacks described above.

BRIEF SUMMARY OF THE INVENTION

In one embodiment, a fastener actuation system may include: a fastener actuation tool coupled to a pole assembly, the tool comprising: a housing having a barrel assembly slidable therein, the barrel assembly having a muzzle end and a breech end, a piston slidable within the barrel assembly, a breech block coupled to the housing, a firing pin assembly slidable within the breech block, a trigger sleeve, and a lockout mechanism proximate a rearward end of the tool. The system also may include a pole assembly comprising: a pole extending substantially along a length of the pole assembly, an internal rod within, and slidable with respect to, the pole, and a sleeve external to the pole and coupled to the internal rod. The lockout mechanism may include a receptacle and a ball, where the lockout mechanism operatively engages the internal rod and trigger sleeve when the ball is disposed within the receptacle and does not operatively engage the trigger sleeve when the ball is not disposed within the receptacle. When the ball is not disposed within the receptacle, a gap between the trigger sleeve and a bottom of the receptacle may be about ⅜".

The lockout mechanism may include a shaft generally aligned with the internal rod and a spring disposed around the shaft. The trigger sleeve may include a protrusion extending rearwardly that may be generally aligned with the internal rod. In addition, the housing may include a cavity having an internal wall, the trigger sleeve may include a protrusion extending rearwardly, and the ball may have a diameter, where the protrusion is spaced a radial distance from the internal wall at least a distance as large as the diameter. Moreover, a forward end of the lockout mechanism, which may taper inwardly, may be spaced a distance from the internal wall smaller than the diameter.

In another embodiment, a fastener actuation tool may include: a housing, a barrel assembly at least partially contained within, and slidable with respect to, the housing, a piston within, and slidable with respect to, the barrel assembly and the housing, a breech block generally fixed with respect to the housing, a firing pin assembly at least partially contained within, and slidable with respect to, the breech block, a trigger sleeve slidable with respect to the housing and the firing pin assembly, and a lockout mechanism disposed rearward of the trigger sleeve, the lockout mechanism including a ball and a receptacle, the ball disposed within the receptacle when the tool is in an acceptable firing position. The lockout mechanism also may include a shaft extending rearward from the receptacle. The barrel assembly further may include a cocking rod, wherein depressing the barrel assembly causes the cocking rod to contact the firing pin assembly and move the firing pin assembly into a ready-to-fire position.

The housing may include a cavity having a tapered rear end. Similarly, the receiver may include a flange having a tapered underside, and the rear end and the underside may taper at substantially the same rate. In addition, the trigger sleeve may include a rearward facing protrusion, which the receptacle may be configured to receive. There also may be a gap between the protrusion and a bottom of the receptacle when the lockout mechanism is disposed in a forwardmost position and the ball is not disposed within the receptacle. The housing may include an internal wall forming a generally cylindrical cavity, and the trigger sleeve may include a protrusion generally coaxial with the cavity, where a distance between the internal wall and the protrusion is at least as large as a diameter of the ball.

In still another embodiment, a fastener actuation tool may include: a housing having an internal wall forming a cavity having at least a first section and a second section, a barrel assembly at least partially extending forward of the housing's front end, a triggering mechanism slidable within the first section of the cavity, the second section of the cavity including an open rearward end and connection means configured to connect the tool to a pole assembly, and a lockout mechanism partially disposed in the cavity's first section and partially disposed in the cavity's second section, where the lockout mechanism may include a spring configured to bias the mechanism to a rearward resting position. There may be a flange between the first and second sections of the cavity and a retainer extending outward from the shaft of the lockout mechanism, and the spring may be disposed between the flange and the retainer.

The lockout mechanism may include a ball, a receptacle, and a flange surrounding an open end of the receptacle. The ball may be configured to be received by the receptacle when the tool is oriented with the barrel assembly pointed upwards and to be disposed within the cavity, outside the receptacle, when the tool is oriented with the barrel assembly pointed horizontally. At angles in between, the tool may be designed, e.g., with a certain flange angle or receptacle depth, to locate the ball within or outside the receptacle. Preferably the receptacle depth may be at least about ½ the ball diameter. In addition, the first section of the cavity may include a generally cylindrical portion, and the flange may be spaced radially from the generally cylindrical portion a distance less than the diameter of the ball.

These and other features and advantages are evident from the following description of the present invention, with reference to the accompanying drawings.

DETAILED DESCRIPTION OF THE INVENTION

Figure 1:
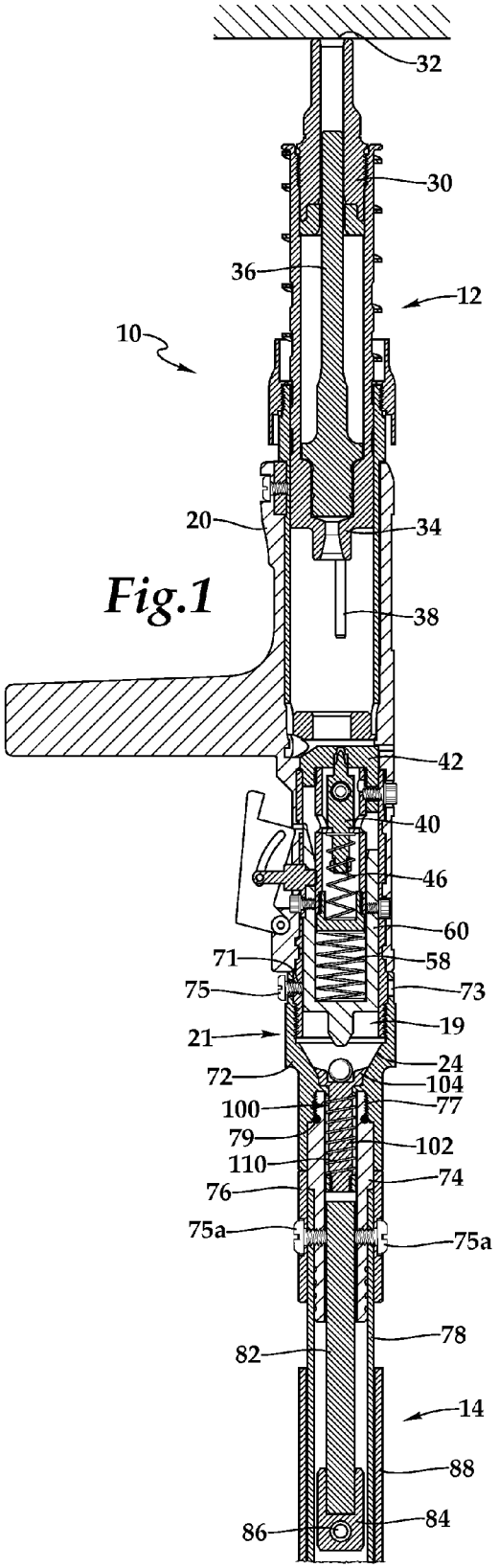
FIG. 1 is a sectional view of an exemplary tool in an initial or final position.

Details of one embodiment of a tool 12 with which lockout mechanism 100 may be used may be described in U.S. Pat. No. 7,896,210, column 3, line 26—column 5, line 39 of which are incorporated herein by reference.

As seen in FIG. 1, tool 12 may include lockout mechanism 100 proximate a rear portion 21 of housing 20. Housing 20 may include a generally cylindrical cavity 19 through which trigger sleeve 60 translates in order to load and fire tool 12. At its rear end, cavity 19 may taper extending rearward. Preferably, tapering is generally constant along its length and about a circumference so as to form a generally frustoconical wall 24.

Wall 24 may be formed as an internal wall as part of housing 20. Alternatively, coupler 72 may couple to housing, e.g., via threaded engagement at rear 21 of housing. Coupler 72 may be open at at least one end, and wall 24 may be formed within coupler 72, inward from the open end.

Coupler 72 may include one or more openings 73 about its perimeter, and housing 20 similarly may include one or more openings 71 about its perimeter. As coupler 72 is rotated about housing 20, opening 73 may align with opening 71, and fastener 75 may be inserted and/or threaded through both to prevent reverse rotation of coupler 72.

Tool 12, e.g., at coupler 72 may include connection means 77 to releasably couple tool 12 to pole assembly 14, e.g., with coupler 74. As seen in FIG. 1, connection means 77 may include mating threading between tool 12 and pole assembly 14. Connection means also may include a friction or interference fit, a tab/slot or spring loaded button/hole-type arrangement, or any other type of connection that allows for firm, yet releasable engagement. Connection means 77 also may include a washer, o-ring, or similar gasket 79 between couplers 72, 74. Gasket 79 may assist in keeping pole assembly 14 firmly coupled to tool 12, preventing loosening of pole assembly 14, and/or preventing debris from entering into tool.

Pole assembly 14 may include a pole 78 extending substantially the length of pole assembly 14 to a handle. Pole assembly 14 may come in various lengths, e.g., about 3 ft., about 6 ft. or about 8 ft. lengths, so that tool system 10 may be adaptable to a variety of uses. In addition, pole assembly 14 may include one or more extenders for coupling to a forward end of pole assembly 14 in order to further lengthen pole assembly 14. Moreover, pole 78 may have an outer diameter of between about ½ inch and about 2 inches, preferably between about ¾ inch and about 1½ inches, still more preferably about 1 inch. Pole 78 may also have an inner diameter of between about ¼ inch and about 1½ inches, preferably between about ½ inch and about 1 inch, still more preferably about ¾ inches.

Second coupler 74 may extend a predetermined distance inside pole 78, for example, via a threaded or interference fit, which may serve to reinforce pole 78. Second coupler 74 may extend between about 1 inch and about 6 inches into pole 78, preferably between about 1 inch and about 4 inches. In one embodiment, second coupler 74 may also fit over the end of pole 78 and extend a second predetermined distance along outside of pole 78. Alternatively, or in addition, assembly 14 may also include a reinforcing sleeve 76 proximate second coupler 74 and extending around an outer surface of pole 78. Reinforcing sleeve may be coupled to pole 78 and/or to second coupler 74, for example, through the use of one or more fasteners 75*a*. Like fasteners 75, fasteners 75*a* also may prevent reverse rotation of pole 78 relative to second coupler 74.

Pole assembly additionally includes an internal rod 82 within pole 78, which may extend substantially along the length of pole 78. Internal rod 82 may be coupled to cap 84, preferably proximate one end of rod 82. As with pole 78, internal rod 82 may come in various lengths, each of which is preferably shorter than its corresponding pole 78 length. For example, a 3 foot pole 78 may have an internal rod 82 about 31 inches long, a 6 foot pole 78 may have an internal rod 82 about 67 inches long, and an 8 foot pole 78 may have an internal rod 82 about 91 inches long. Internal rod 82 may also be sized smaller than inner diameter of pole 78. Preferably, internal rod 82 may have a diameter about half that of inner diameter of pole 78.

Cap 84 may be coupled in various ways to internal rod, such as by press fitting cap 84 over internal rod 82. Alternatively, connector such as pin 86 may pass through cap 84 and internal rod 82, as well as sleeve 88. Pole 78 may have one or more slots along which pin may travel, so as to allow sleeve 88 to move along a length of pole 78, thereby actuating tool system 10. Slots 80 may have a length between about ½ inch and about 6 inches, preferably between about ½ inch and about 2 inches, still more preferably between about ½ inch and about 1 inch, and in one embodiment, about ¾ inch. In addition, sleeve 88 may extend substantially along the length of pole 78 in order to provide a user with a variety of hand placement options. Sleeve 88 may be between about 10% and about 85% a length of pole 78, preferably between about 40% and about 85%, still more preferably between about 65% and about 85%. However, sleeve 88 may also be relatively short, for example between about 4 inches and about 6 inches, which may provide adequate surface area for a user's hand while requiring less material to make sleeve 88. In this case, sleeve 88 may be coupled to a secondary sleeve proximate second coupler 74.

Figure 5:
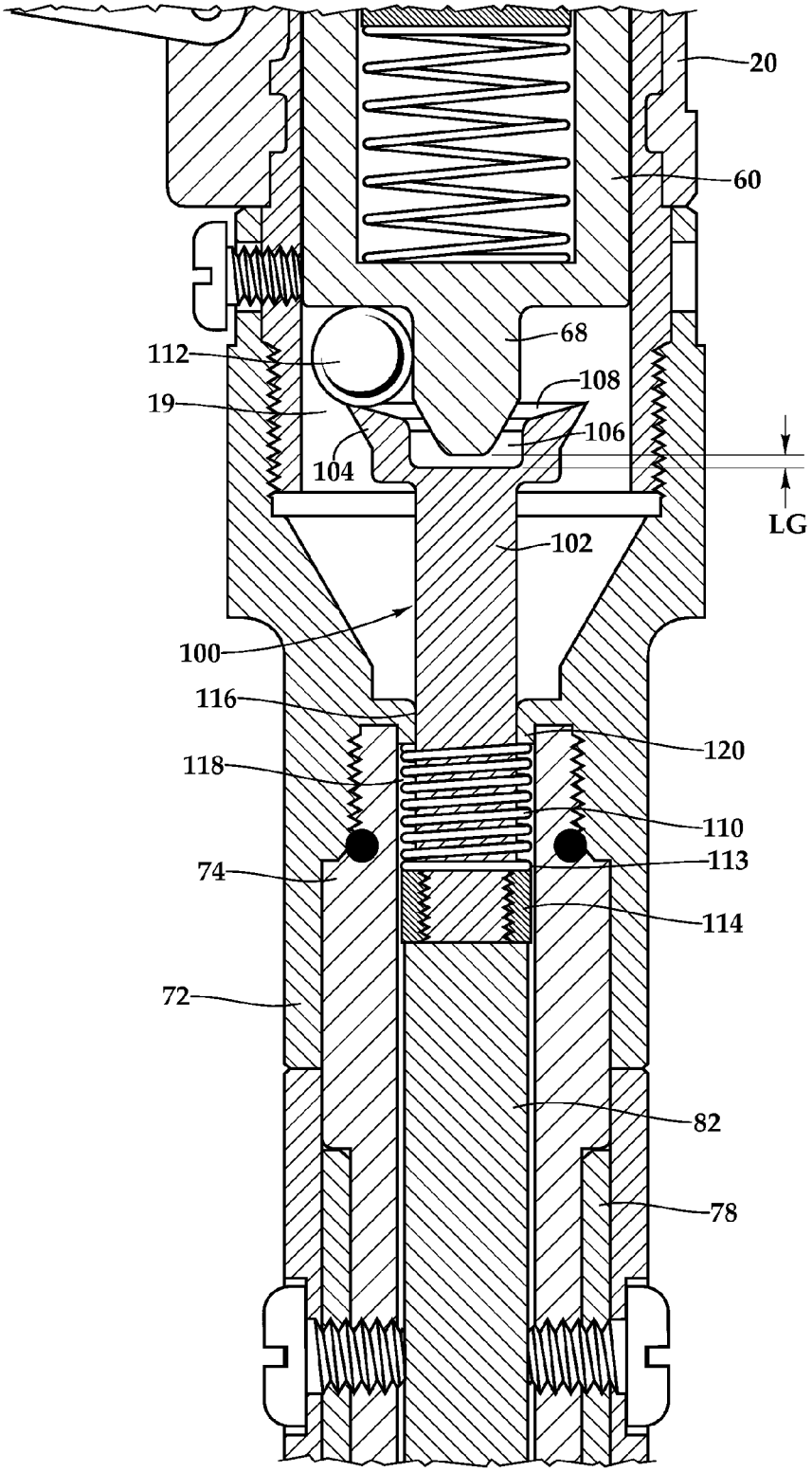
FIG. 5 is a detail view of the lockout mechanism shown in FIG. 4.

Turning to the detail view of FIG. 5, tool system 10 may include lockout mechanism 100, which may be disposed within tool 12. Lockout mechanism 100 may include a shaft 102 extending rearward from tool 12 through opening 116 in coupler 72 of tool 12 and opening 118 in coupler 74 of pole assembly 14. Openings 116 and 118 may be substantially similarly sized and may be slightly larger than a diameter of shaft 102. Second coupler additionally may include a flange 120 at opening 118, such that inner bore of second coupler 74 may expand past flange 120.

Alternatively, second coupler 74 may not have separate flange 120. Instead, opening 118 of second coupler may be larger than opening 116 of first coupler 72, such that flange may be created by abutment of first coupler 72 with second coupler 74.

Shaft 102 may include a connector 114, which also may be considered abutment means, between lockout mechanism 100 and internal rod 82. Connector 114 may be a collar or retainer 113 configured to fit around shaft 102 and to increase radial extent of shaft 102. Alternatively, shaft 102 may have a threaded end, and connector 114 may comprise a nut configured to thread onto shaft, e.g., a locking nut that may resist unthreading.

Lockout mechanism 100 may include spring 110, which preferably is a compression spring. Spring 110 may surround shaft 102 and may be disposed between flange 120 and connector 114. As such, spring 110 may serve one or more purposes, e.g., biasing lockout mechanism 100 to an initial, pre-firing position and inhibiting misfiring by biasing lockout mechanism 100 away from trigger sleeve.

At an opposite end of shaft 102 from connector 114, lockout mechanism 100 may include a receptacle or receiver 104 for receiving one or more balls 112. Receiver 104 may include a cradle or well 106 configured to receive ball 112 when tool is oriented in an acceptable configuration, e.g., upward or generally above a horizontal. Well 106 may have a depth smaller than a diameter of ball 112, such that ball 112 may roll out of well more easily as tool 12 is lowered from an upright configuration. The deeper well 106 is, the longer ball 112 may be retained within well 106, permitting firing of tool 12. Conversely, a shallower well 106 may allow ball 112 to be roll out more easily. Well 106 may have a depth between about 10% and about 90% of the radius of ball 112, preferably between about 25% and about 75% of the radius, and in one embodiment, about 50% of the radius.

Lockout mechanism 100 also may include tapered flange 108 surrounding open end of well 106. In one embodiment, flange 108 may taper downwards from an outer edge to open end of well 106 between about 5 degrees and about 30 degrees, preferably about 15 degrees. In addition, flange may extend radially outward a sufficient distance to prevent ball 112 from falling behind flange, i.e., to prevent flange 108 from being between trigger sleeve 60 and ball 112.

At the same time, flange 108 may not extend outward so far as to contact walls of housing cavity 19. As seen in FIG. 5, flange 108 may be about ½ the width of cavity diameter, ball 112 may have a diameter about ⅓ a width of cavity diameter, and protrusion 68 also may have a diameter of about ⅓ a width of cavity diameter. As such, when not in well 106, ball 112 may move freely around protrusion 68 without becoming jammed or wedged between cavity and protrusion. Additionally, lockout mechanism 100 and trigger sleeve 60 may be sized and spaced so that ball 112 may fit between lockout mechanism 100 and trigger sleeve 60 and not cause trigger sleeve 60 to be advanced when ball 112 is not disposed within receiver 104. For example, rear end of trigger sleeve 60 proximate protrusion 68 may be spaced a distance at least as large as diameter of ball 112 from a forward end of lockout mechanism 100.

Similarly, well 106 may partially receive protrusion 68 extending rearward from trigger sleeve 60 when tool is oriented in an unacceptable configuration, e.g., generally at or below a horizontal. In this configuration, ball 112 may not be disposed within well 106. Additionally, lockout mechanism 100 may be configured such that, when ball 112 is not disposed in well 106, a lockout gap LG may remain between trigger sleeve 60 and rod 82, even when rod 82 is translated to a fully forward position. By preventing contact between protrusion 68 of trigger sleeve 60 and rod 82, trigger sleeve 60 is prevented from sliding forward and releasing firing pin, which would lead to firing of tool. Gap may be between about 1/16" and about 1", preferably between about ¼" and about ½", and in one embodiment, about ⅜".

In addition to tip of protrusion 68 being spaced apart from a bottom of well 106, protrusion 68 may have a tapered end, e.g., forming a frustoconical portion, so that sides of protrusion 68 also are spaced from sides of well 106. Spacing may be large enough to prevent inadvertent contact between protrusion 68 and lockout mechanism 100 while being small enough to prevent ball 112 from passing through the gap and into well 106. This sidewall spacing gap may be generally equal to lockout gap LG proximate the bottom of protrusion 68.

FIGS. 1-4 illustrate how tool system 10 with lockout mechanism 100 may be used. As seen in FIG. 1, prior to being depressed against a substrate, barrel assembly 30 of tool 12 may extend outward from tool housing 20. Barrel assembly 30 may have a muzzle end 32 protruding forward from housing 20 and a breech end 34 spaced rearward from muzzle end 32 and contained within housing 20. Tool 12 also may comprise breech block 42 having a forward end. Breech block 42 may be shaped similarly to breech end 34 of barrel assembly 30 so that barrel assembly 30 may substantially interface with breech block 42 when muzzle end 32 of tool 12 is depressed against a work surface. Firing pin assembly 40 may be disposed in a forward position, with spring 46 in a relatively uncompressed, starting position. In addition, with respect to pole assembly 14, sleeve 88 coupled to rod 82 both may be in a rearward position. As such, there may be a gap between rod 82 and lockout mechanism 100. Additionally or alternatively, gap between well 106 of lockout mechanism 100 and protrusion 68 of trigger sleeve 60 may be larger than diameter of ball 112. Even if ball 112 is disposed within well 106, this spacing may allow for ball 112 to become unseated from well 106 to roll to an area not aligned with protrusion 68. Conversely, if tool system 10 is in an acceptable firing position, ball 112 may roll to a position generally within well 106 and generally aligned with protrusion 68, although a gap still may exist between ball 112 and protrusion.

Figure 2:
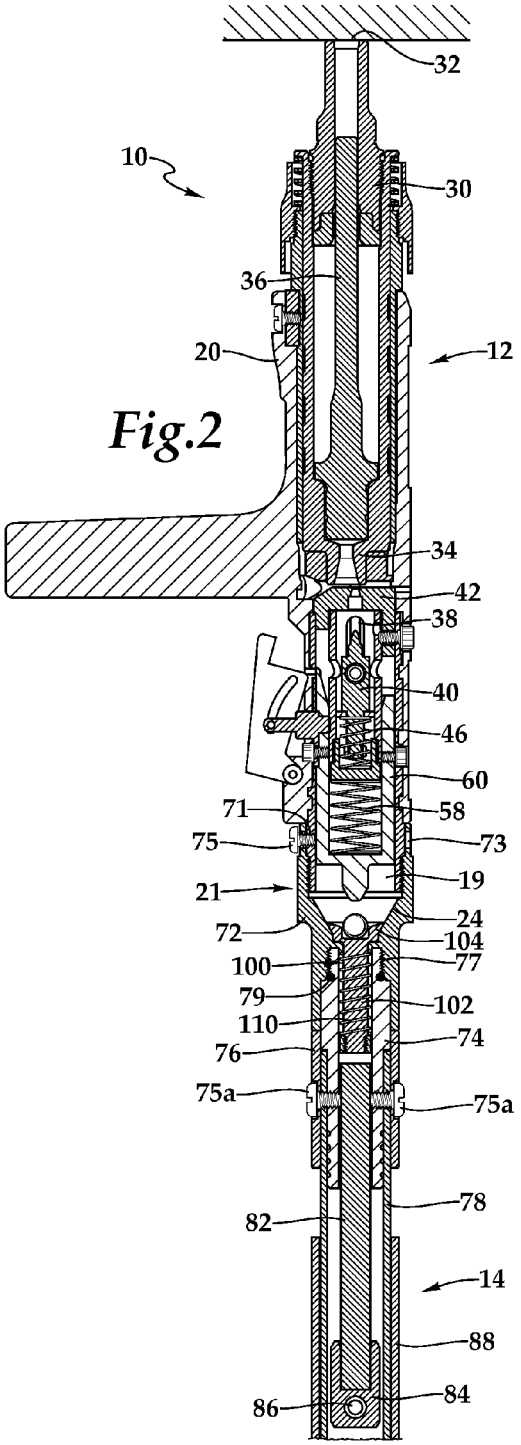
FIG. 2 is a sectional view of the tool of FIG. 1 in a ready-to-fire position.
Figure 4:
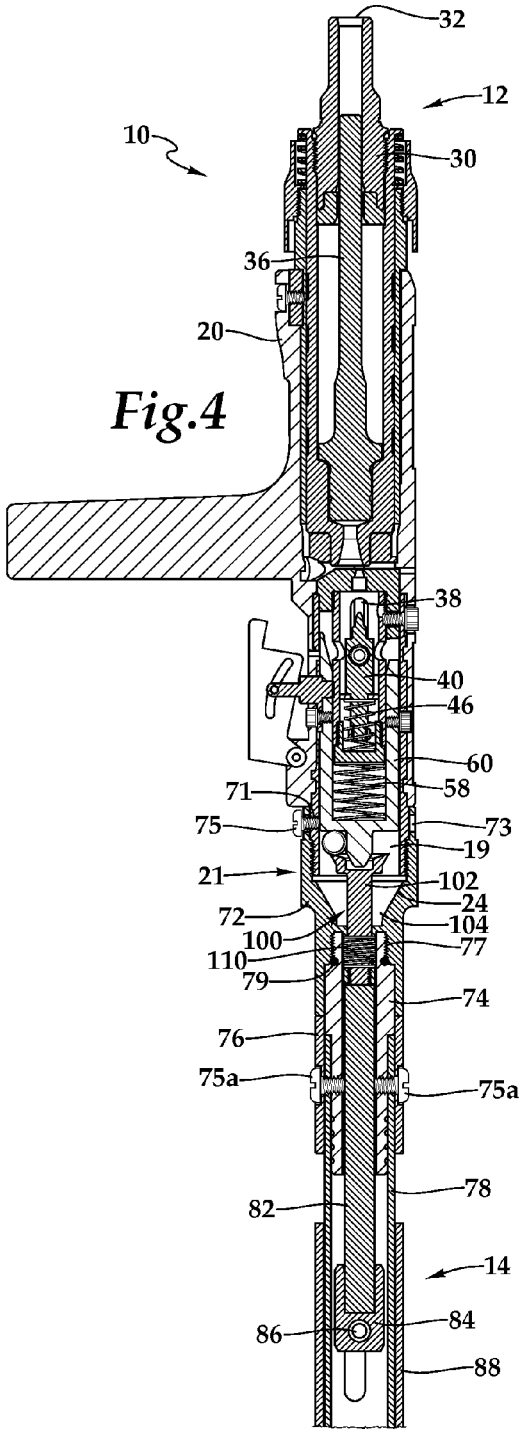
FIG. 4 is a sectional view of the tool of FIG. 1 in an orientation with firing inhibited by a lockout mechanism.

Turning now to FIG. 2, as barrel assembly 30 is pressed against substrate, cocking rod 38 may move rearward until operatively engaging firing pin assembly 40, thereby driving firing pin assembly 40 rearward and compressing spring 46 and loading firing pin assembly 40 into a ready-to-fire position. In FIG. 2, ball 112 is shown within receiver 104, although firing pin assembly 40 similarly may be loaded into ready-to-fire position even if ball is outside of receiver, as seen in FIG. 4.

Figure 3:
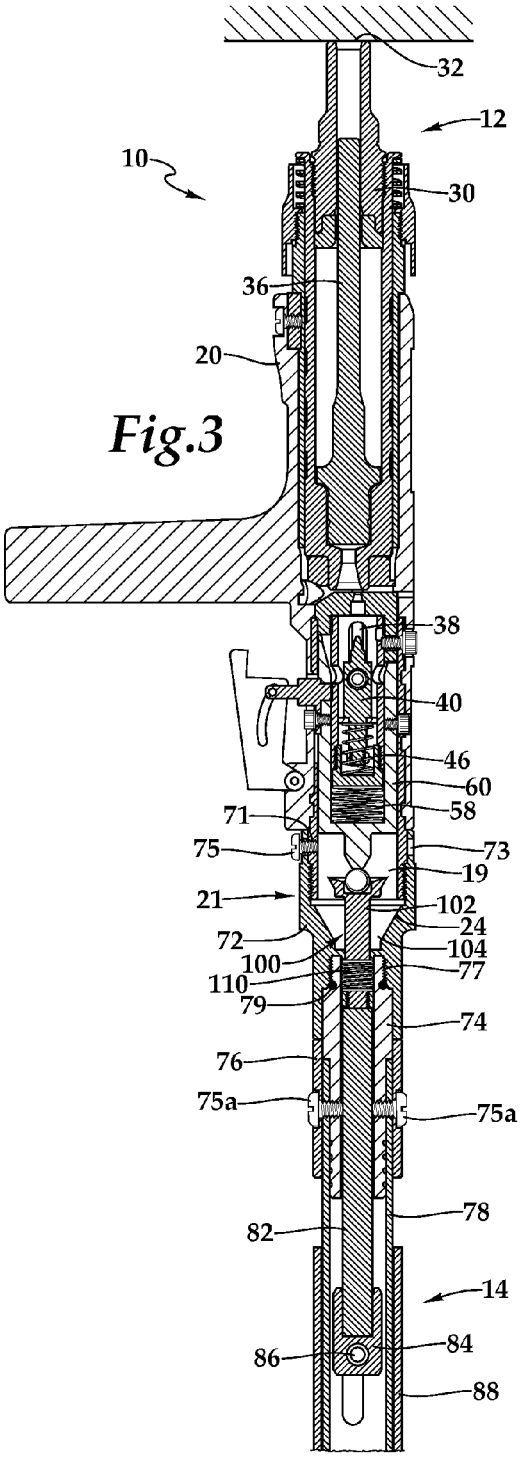
FIG. 3 is a sectional view of the tool of FIG. 1 just prior to being fired.

Turning further to FIG. 3, with firing pin assembly 40 in ready-to-fire position and ball 112 with receiver 104 of lockout mechanism, to actuate tool system 10, sleeve 88 may be moved upwards toward tool 12. By virtue of operative coupling, rod 82 of pole assembly 14 similarly may be moved towards tool. End of rod 82 may contact lockout mechanism 100, e.g., via shaft 102 and/or nut 114. As rod 82 continues to be moved forward, lockout mechanism 100 and ball 112 also move forward, bridging gap between ball 112 and trigger sleeve 60 and then causing trigger sleeve 60 to be moved forward, compressing spring 58. Eventually, trigger sleeve 60 reaches a firing position, whereby tension on firing pin spring 46 is released, releasing firing pin assembly 40 toward a load, detonating the load. Detonation may drive piston 36 forward, driving fastener out of muzzle end 32 and into work surface.

Actuating lockout mechanism 100 forward also may cause spring 110 to compress against nut 114.

After firing, the user may release the sleeve 88 or relieve forces caused by actuation of sleeve 88. For example, one or both of springs 58 and 110 may extend back to their initial positions, biasing trigger sleeve 60 and lockout mechanism 100, respectively, to rearward configurations, at which point tool system 10 may be readied for reloading and/or refiring.

Turning to FIG. 4, if tool system 10 is disposed at an unacceptable angle, e.g., horizontally, and pressed against a work surface, firing pin assembly 40 may be compressed into a ready-to-fire position. In this configuration, however, ball 112 may roll into a portion of housing cavity 19 not aligned with lockout mechanism 100 and/or trigger sleeve protrusion 68. Thus, if the user actuates sleeve 88 and/or rod 84 fully forward, lockout mechanism 100 may move forward and spring 110 may compress, but gap LG may not be bridged. Thus, trigger sleeve 60 may be prevented from moving forward, preventing firing pin assembly 40 from being released and tool 12 from firing.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. A fastener actuation system, comprising:
a fastener actuation tool coupled to a pole assembly,
said fastener actuation tool comprising:
a housing having a barrel assembly slidable therein, said barrel assembly having a muzzle end and a breech end;
a piston slidable within said barrel assembly;
a breech block coupled to said housing;
a firing pin assembly slidable within said breech block;
a trigger sleeve; and
a lockout mechanism proximate a rearward end of said tool;
said pole assembly comprising:
a pole extending substantially along a length of said pole assembly;
an internal rod within said pole and slidable with respect to said pole; and
a sleeve external to said pole and coupled to said internal rod;
wherein said lockout mechanism comprises a receptacle and a ball;
wherein said lockout mechanism operatively engages said internal rod and said trigger sleeve when said ball is disposed within said receptacle; and
wherein said lockout mechanism does not operatively engage said trigger sleeve when said ball is not disposed within said receptacle.

2. A fastener actuation system according to claim 1, said lockout mechanism further comprising a shaft generally aligned with said internal rod.

3. A fastener actuation system according to claim 2, said lockout mechanism further comprising a spring disposed around said shaft.

4. A fastener actuation system according to claim 1, wherein said trigger sleeve includes a protrusion extending rearwardly, said protrusion generally aligned with said internal rod.

5. A fastener actuation system according to claim 1,
said housing including a cavity having an internal wall;
said trigger sleeve including a protrusion extending rearwardly; and
said ball having a diameter;
wherein said protrusion is spaced a radial distance from said internal wall at least a distance as large as said diameter.

6. A fastener actuation system according to claim 1,
said housing including an internal wall forming a cavity; and
said ball having a diameter;
wherein a forward end of said lockout mechanism is spaced a distance from said internal wall smaller than said diameter.

7. A fastener actuation system according to claim 1, wherein a forward end of said lockout mechanism tapers inwardly.

8. A fastener actuation system according to claim 1, wherein, when said ball is not disposed within said receptacle, a gap between said trigger sleeve and a bottom of said receptacle is about ⅜".

9. A fastener actuation tool comprising:
a housing;
a barrel assembly at least partially contained within said housing and slidable with respect to said housing;
a piston within said barrel assembly and slidable with respect to said barrel assembly and said housing;
a breech block generally fixed with respect to said housing;
a firing pin assembly at least partially contained within said breech block and slidable with respect to said breech block;
a trigger sleeve slidable with respect to said housing and said firing pin assembly; and
a lockout mechanism disposed rearward of said trigger sleeve, said lockout mechanism including a ball and a receptacle, said ball disposed within said receptacle when said tool is in an acceptable firing position.

10. A fastener actuation tool according to claim 9, wherein said barrel assembly further comprises a cocking rod, wherein depressing said barrel assembly causes said cocking rod to contact said firing pin assembly and move said firing pin assembly into a ready-to-fire position.

11. A fastener actuation tool according to claim 9, wherein said lockout mechanism includes a shaft extending rearward from said receptacle.

12. A fastener actuation tool according to claim 9,
said housing including a cavity having a tapered rear end, and
said receptacle including a flange having a tapered underside;
wherein said tapered rear end and said tapered underside taper at substantially the same rate.

13. A fastener actuation tool according to claim 9, said trigger sleeve including a rearward facing protrusion, said receptacle configured to receive said protrusion.

14. A fastener actuation tool according to claim 13, further comprising a gap between said protrusion and a bottom of said receptacle when said lockout mechanism is disposed in a forwardmost position and said ball is not disposed within said receptacle.

15. A fastener actuation tool according to claim 9, said housing including an internal wall forming a generally cylindrical cavity;

said trigger sleeve including a protrusion generally coaxial with said cavity;

wherein a distance between said internal wall and said protrusion is at least as large as a diameter of said ball.

16. A fastener actuation tool according to claim 15, said lockout mechanism including a ball having a diameter and a receptacle having a depth;

wherein said receptacle depth is at least about ½said ball diameter.

17. A fastener actuation tool according to claim 15, said ball having a diameter, said receptacle having a flange, and said flange surrounding an open end of said receptacle;

wherein said first section of said cavity includes a generally cylindrical portion; and wherein said flange is spaced radially from said generally cylindrical portion a distance less than said diameter of said ball.

18. A fastener actuation tool, comprising:

a housing having an internal wall forming a cavity having at least a first section and a second section;

a barrel assembly at least partially extending forward of a front end of said housing;

a triggering mechanism slidable within said first section of said cavity;

said second section of said cavity including an open rearward end and further including connection means configured to connect said tool to a pole assembly; and a lockout mechanism partially disposed in said first section of said cavity and partially disposed in said second section of said cavity;

a flange between said first and second sections of said cavity;

a retainer extending outward from said shaft of said lockout mechanism;

said lockout mechanism further comprising a spring configured to bias said lockout mechanism to a rearward resting position wherein said spring is disposed between said flange and said retainer.

19. A fastener actuation tool according to claim 18, said lockout mechanism including a ball and a receptacle;

said ball configured to be received by said receptacle when said tool is oriented with said barrel assembly pointed upwards;

said ball configured to be disposed within said cavity, outside said receptacle, when said tool is oriented with said barrel assembly pointed horizontally.

* * * * *